United States Patent [19]

Kita

[11] 4,044,688

[45] Aug. 30, 1977

[54] MONORAIL TRANSPORT APPARATUS

[75] Inventor: Kazuharu Kita, Kobe, Japan

[73] Assignee: Senyo Kiko Kabushiki Kaisha, Osaka, Japan

[21] Appl. No.: 642,404

[22] Filed: Dec. 19, 1975

[30] Foreign Application Priority Data

June 24, 1975 Japan ..... 50-78733

[51] Int. Cl.[2] ..... B61C 11/00

[52] U.S. Cl. ..... 105/30; 104/118; 104/165; 104/246; 105/141

[58] Field of Search ..... 104/246, 245, 242, 229, 104/230, 232, 237, 202, 165, 163, 147 R, 118, 119, 120, 121; 105/141, 144, 146, 147, 148, 150, 152, 156, 153, 101, 103, 30, 145; 273/32 E; 280/47.26

[56] References Cited

U.S. PATENT DOCUMENTS

| | | | |
|---|---|---|---|
| 2,228,034 | 1/1941 | Nelles | 105/30 |
| 2,312,518 | 3/1943 | Baldwin | 105/30 |
| 3,074,354 | 1/1963 | Wakkila | 104/147 R |
| 3,381,541 | 5/1968 | Thireau et al. | 105/30 X |
| 3,828,691 | 8/1974 | Purath | 105/145 |
| 3,834,319 | 9/1974 | Kastenbein | 104/246 |
| 3,838,648 | 10/1974 | Dahlberg et al. | 104/139 |

*Primary Examiner*—Robert J. Spar
*Assistant Examiner*—Randolph A. Reese
*Attorney, Agent, or Firm*—Armstrong, Nikaido & Marmelstein

[57] ABSTRACT

There is disclosed a monorail transport apparatus for transport of golf equipment in golf links, comprising a transport vehicle body provided with a caster wheel rollable on a monorail, a driving vehicle body equipped with a prime mover and partly received in and pivotally connected to the front portion of the transport vehicle body so as to be swingable around the axis of a transverse shaft, a driving wheel and a driven wheel disposed on both sides of the transverse shaft, an endless driving belt entrained around the driving and driven wheels and pressed against the upper surface of the monorail, and an auxiliary wheel pivotally connected to the driving vehicle body so as to be swingable around the axis of the transverse shaft and pressed against the lower surface of the monorail, the arrangement being such that the transport apparatus travels while holding the monorail from above and below between said driving belt and the auxiliary wheel, thereby achieving increased hill climbing ability and increased traveling stability irrespective of the sinuousity of the monorail.

5 Claims, 6 Drawing Figures

MONORAIL TRANSPORT APPARATUS

BACKGROUND OF THE INVENTION

The present invention relates to a monorail transport apparatus used primarily for automatically transporting golf equipment to its destination in golf links.

Recently, in golf links, reflecting the shortage of caddies, there has been employed a transport system comprising an elevated monorail laid in the compound of golf links and a transport apparatus which travels along said monorail for automatically transporting golf equipment to its destination. The conventional monorail transport apparatus of this type, however, encounters the problem of being lacking in its hill climbing ability when it approaches a slope of the monorail, since usually it is constructed to have two wheels, front and rear, on the vehicle body, having a very small area of contact with the monorail. Accordingly, rubber wheels are used as said two wheels and auxiliary wheels are provided which are pressed against the lower surface of the monorail to cooperate with the rubber wheels to hold the monorail therebetween while they are rolling on the monorail. Alternatively, a separate auxiliary rail is laid only in a slope rail region and it is toothed to form a rack while a pinion meshing therewith is provided on the vehicle body of the transport apparatus. Such measures are intended to increase the traveling force when the transport apparatus goes up a slope. However, in the former construction, the rubber wheels and the auxiliary wheels are independent of each other and individually contact the monorail, so that the area of contact increases simply in proportion to the number of wheels. Thus, with a small number of wheels it is impossible to greatly increase the area of contact. In the case of a transport apparatus according to the latter construction, the necessity of laying auxiliary rails corresponding to rail slope region has the disadvantage of counterbalancing the inherent merits of a monorail transport system.

SUMMARY OF THE INVENTION

The present invention has been developed to solve the above problems. Accordingly, objects of the present invention are: first, to provide a monorail transport apparatus wherein efficient use is made of an endless driving belt to provide an increased area of contact with the monorail, i.e., an increased coefficient of friction, to thereby provide an increased traveling force required for going up slopes; secondly, to provide a monorail transport apparatus wherein the vehicle body has an improved support construction for an endless driving belt, thereby avoiding the so-called unilateral contact condition of the endless driving belt occurring at the start of "hill" climbing as the apparatus comes to a slope region from a horizontal region of the monorail; and thirdly, to provide a monorail transport apparatus wherein the surface pressure on the endless belt in respective regions corresponding to the driving and driven wheels, i.e., the pressing force on the monorail is uniformed, thereby ensuring stabilized travel of the apparatus. Other objects of the invention will appear from the following description.

DESCRIPTION OF THE PREFERRED EMBODIMENT

Figure 2:
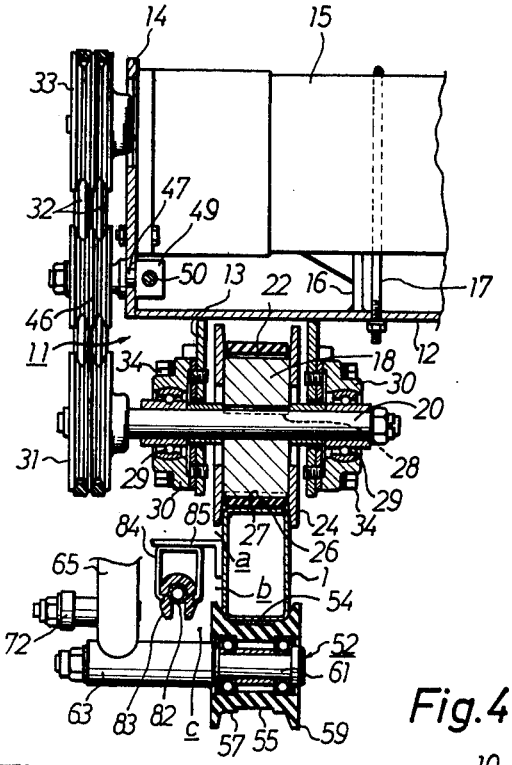
FIG. 2 is a front view, partly broken away, of the same.

The drawings illustrate a monorail transport apparatus according to the present invention, which is applied as an automatic transport system for golf equipment. Designated at 1 is a monorail of rectangular cross-section installed along a golf course by using unillustrated supports. Designated at 2 is a transport vehicle body equipped with a mounting frame (not shown) for carrying bags containing golf equipment, said body comprising a top plate 3 and a pair of opposed side plates 4. Pivotally mounted below said top plate and disposed between the rear end and the center thereof is a caster wheel 8 through a swivel base 5, a bracket 6 and a support shaft 7. The caster wheel 3 is free to roll on the monorail 1 and is formed with axially spaced flanges 9 for prevention of running off the monorail 1. A driving vehicle body 11 is partly received in the transport vehicle body and pivotally connected to the front lower portion of said side plates 4 constituting the transport vehicle body 2, so as to be swingable around the axis of a transverse shaft 10. In other words, the driving vehicle body 11 and the transport vehicle body 2 are made as separate units in advance and then they are pivotally connected together in mutually receiving relation by the transverse shaft 10 so as to be capable of executing swing motion. The driving vehicle body 11, as also shown in FIG. 2, comprises a prime mover mounting base 12 and a pair of approximately trapezoidal swing side plates 13 mounted thereunder. A prime mover attaching plate 14 is secured to one end of said prime mover mounting base 12 to form an L-shaped. A dc motor 15 serving as a prime mover for driving the apparatus is attached to the attaching plate 14 to assume a transverse position. The dc motor 15 contains a speed reducer and a brake and is supported at its end on the prime mover mounting base 12 through a receiving plate 16 and fixed in position on the prime mover mounting base 12 by an inverted U-shaped clamp 17.

Figure 1:
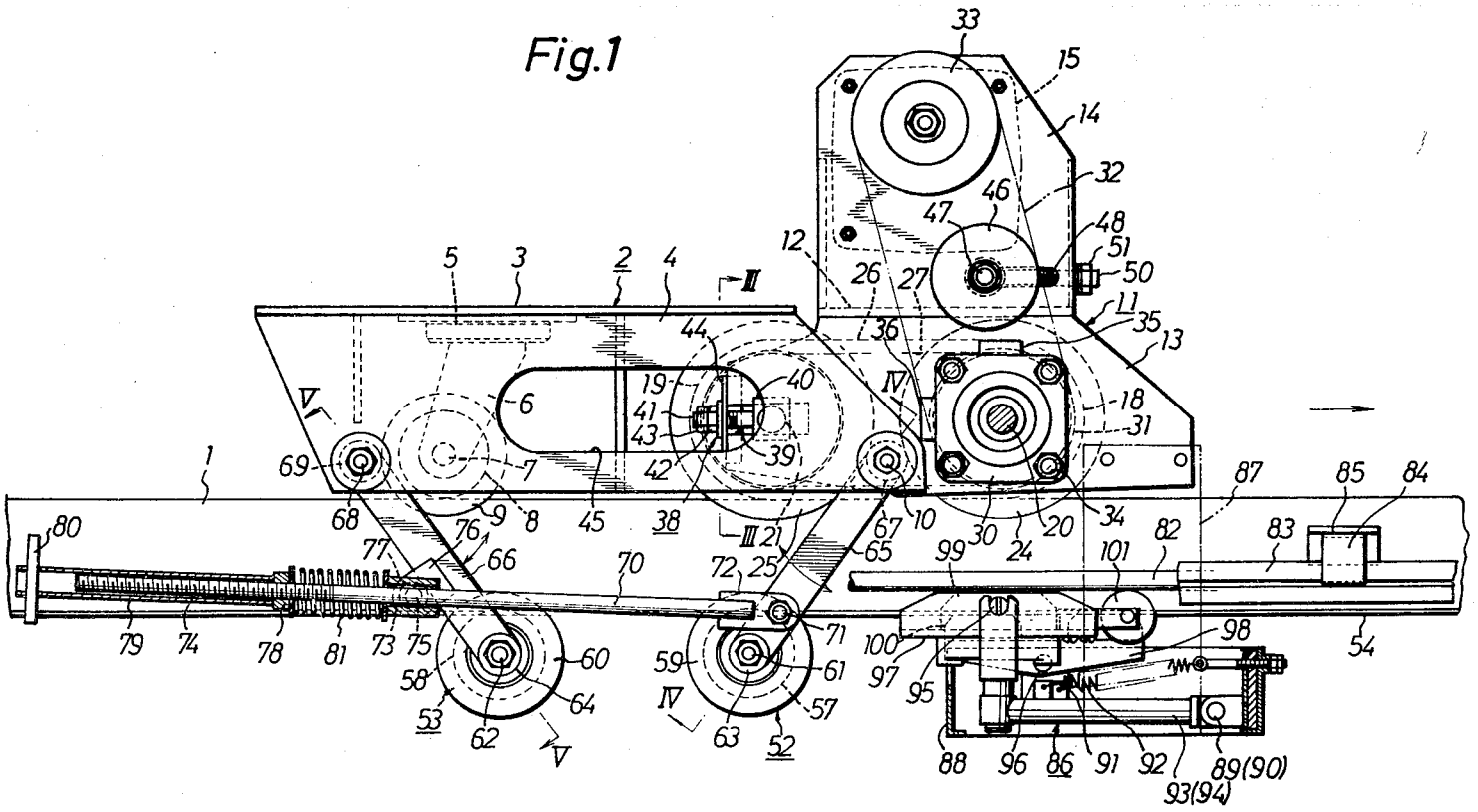
FIG. 1 is a side view, partly broken away, of a preferred embodiment of a monorail transport apparatus according to the present invention.
Figure 3:
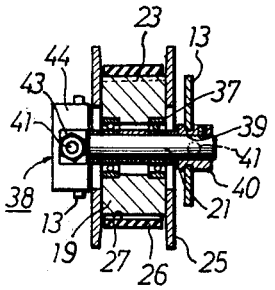
FIG. 3 is a partial sectional view taken along the line III—III of FIG. 1.

A driving wheel 18 and a driven wheel 19 are disposed on opposite sides of the transverse shaft 10 and supported on support shafts 20 and 21, respectively, between the pair of swing side plates 13. In this case, it is most appropriate to dispose the driving and driven wheels 18 and 19 symmetrically with respect to the axis of the transverse shaft 10, from the standpoint of uniform and stable contact with the monorail 1. The driving and driven wheels 18 and 19, as shown in FIGS. 2 and 3, have meshing portions 22 and 23 in the form of corrugations on their outer peripheral surfaces and they also have axially spaced opposed flanges 24 and 25 for prevention of running off the monorail 1. An endless driving belt 26 is entrained around the driving and driven wheels 18 and 19. The inner peripheral surface of the endless driving belt 26 is formed with a mating meshing portion 27 in the form of corrugations engageable with the meshing portions 18 and 19 formed on the outer peripheral surfaces of the driving and driven wheels 18 and 19. Further, the outer peripheral surface of the endless driving belt is roughened to prevent slip between the belt and the monorail 1. Further, the endless driving belt is of special construction to have sufficient strength and wear-resistance. The driving wheel 18, as shown in FIG. 2, is keyed to the support shaft 20 as at 28, while the support shaft 20 is supported for rotation with respect to the swing side plates 13 through axially spaced bearings 29 and bearing cases 30 and has a driving pulley 31 fixed on one end thereof which is operatively connected to an output pulley 33 on the dc motor 15. Each bearing case 30 is square as seen in FIG. 1 and fixed to the associated swing side plate 13 by four bolts 34, with the upper and rear edges thereof abutting against positioning stops 35 and 36. The driven wheel 19, as shown in FIG. 3, is rotatably mounted on the support shaft 21 through bearings 37, said support shaft 21 being supported by the pair of swing side plates 13 through a tension adjusting mechanism 38. The tension adjusting mechanism 38 comprises slides 40 slidably fixed on opposite ends of the support shaft 21 and slidably fitted in elongated openings 39 in the swing side plates 13, an adjusting screw 41 rearwardly projecting from each of said slides 40, and an adjusting nut 42 and a lock nut 43 threadedly fitted over said adjusting screw 41, said adjusting screw 41 being loosely inserted in a control plate 44 mounted on the rear end of the associated swing side plate 13, said nut abutting against the back of said control plate 44. The adjusting nuts 42 and lock nuts 43 are accessible through adjustment windows 45 formed in the side plates 4 of the vehicle body 2 so that they can be easily manipulated for adjustment. Designated at 46 is a tension pulley rotatably supported on a support shaft 47 which extends through an elongated opening 48 formed in the prime mover attaching plate 14 and is fixed to a movable body 49 whose position can be freely varied and then fixed by an adjusting screw 50 and an adjusting nut 51 threadedly fitted thereover.

Figure 4:
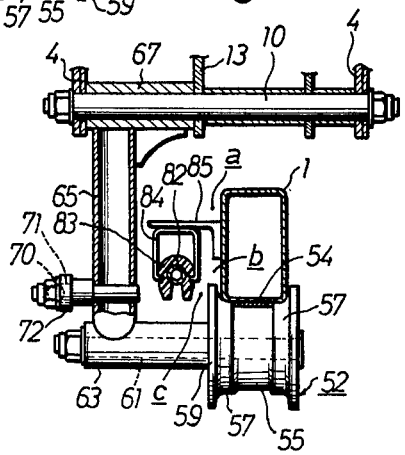
FIG. 4 is a partial sectional view taken along the line IV—IV of FIG. 1.
Figure 5:
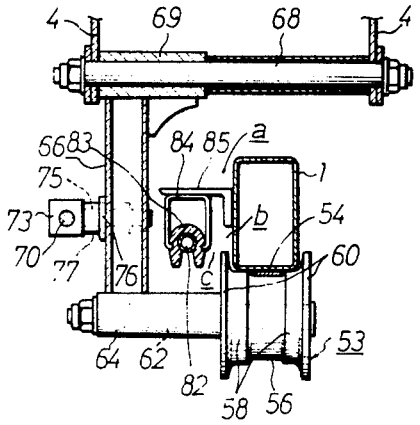
FIG. 5 is a partial sectional view taken along the line V—V of FIG. 1.

Designated at 52 is a front auxiliary wheel and at 53 is a rear auxiliary wheel. These auxiliary wheels 52, 53, as shown in FIGS. 4 and 5, are centrally formed with peripheral grooves 55, 56 for engagement with a feeder line 54, steps 57, 58 of larger diameter on opposite sides thereof for pressure contact rolling on the lower surface of the monorail 1, and flanges 59, 60 for prevention of running off the monorail 1, said auxiliary wheels 52, 53 being rotatably mounted on support shafts 61, 62. These support shafts 61, 62 are longer on one side, where they are retained by cylindrical bodies 63, 64 which are fixed at one of their respective ends to the lower ends of front and rear support levers 65, 66. The front and rear support levers 65, 66 are each formed of a cylindrical body, and the front support lever 65, as shown in FIG. 4, is supported at its upper end by a cylindrical retainer 67 so as to be swingable around the axis of the abovementioned transverse shaft 10 which pivotally interconnects the side plates 4 of the transport vehicle body 2 and the swingable side plates 13 of the driving vehicle body 11, whereas the rear support lever 66, as shown in FIG. 5, is swingably supported by a cylindrical retainer 69 on a travsverse shaft 68 installed between the side plates 4 of the transport vehicle body 2 in the lower rear end region thereof. A pressing rod 70 is pivotally mounted at its front end on a support shaft 71 through a joint 72, said shaft 71 being fixed to the lower end of the front support lever 65, the rear end side of said pressing rod being slidably inserted through a retainer 73 and having a threaded portion 74 extending over a longitudinal predetermined range. The retainer 73 has a support shaft 75 which is rotatably fitted in a cylindrical body 77 mounted on the rear support lever 66 through a bracket 76. A nut 78 threadedly engaged with the threaded portion 74 of the pressing rod 70 is rigidly connected to an operating cylindrical body 79 which is provided at its rear end with an operating lever 80. A compression spring 81 is fitted over the pressing rod 70 between said retainer 73 and said nut 78, so that by varying the threadedly engaged position of the nut 78 it is possible to optionally adjust the spring pressure exerted by the compression spring 81, under which spring pressure the auxiliary wheels 52 and 53 are pressed against the lower surface of the monorail 1.

The feeder line 54 is minus (i.e., it is a return line) and is in the form of a strip extending longitudinally of and secured to the monorail 1 as by rivets in the central region of the lower surface of the monorail 1. Designated at 82 is a plus feeder line (trolley line), which is formed of cylindrical copper wire or the like fitted in an insulating member 83. The insulating member 83 is inverted U-shape in cross section with the lower end longitudinally opened, and it is suspendedly supported by attaching brackets 85 through hangers 84. The attaching brackets 85, as shown in FIGS. 2, 4 and 5, are secured to one side of the monorail 1 in such a manner as to provide upper and lower spaces a and b allowing the passage of the flanges 24, 25 and 9 of the driving wheel 18, driven wheel 19 and caster wheel 8, and the flanges 59 and 60 of the lower wheels 52 and 53. The attaching brackets are arranged longitudinally of the monorail at predetermined intervals of space. The insulating member 83 having the feeder line 82 fitted therein is disposed laterally of and parallel to the monorail 1, with a sufficient transverse spacing c provided therebetween for the flanges 59 and 60 of the lower wheels 52 and 53 to pass therethrough.

Figure 6:
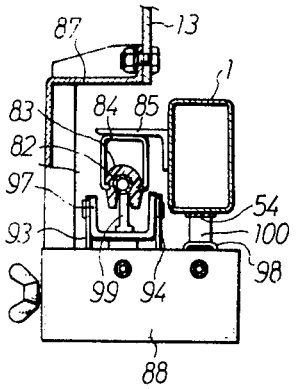
FIG. 6 is a front view partly broken away, illustrating an electric power supply section.

Designated at 86 is a current collector, which, as shown in FIGS. 1 and 6, is installed within a rectangular frame 88 supported by the driving vehicle body 11 through a support bracket 87 and comprises swing arms 93, 94 pivotally mounted for vertical swing motion on support shafts 89, 90 and upwardly urged by tension springs 91, 92, collector shoe retainers 97, 98 supported on pins 95, 96 at the front ends of the swing arms 93, 94, and collector shoes 99, 100 mounted on said retainers. The collector shoe 99, as shown in FIG. 6, enters the lower end opening in the insulating member 83 and is slidable along the feeder line 82, and a guide wheel 101 is disposed forwardly of the collector shoe 99. Further, the collector shoe 100 is slidable along the feeder line 54.

In the arrangement described above, the traveling apparatus is capable of traveling along the monorail 1 while holding the monorail 1 from above and below between the endless driving belt 26 and caster wheel 8 and the front and rear auxiliary wheels 52, 53 and while being prevented from running off the monorail 1 by the flanges 9, 24, 25, 58, 60 either mounted on axially opposite ends of the individual wheels or made integral therewith.

In that case, the adjustment of holding force may be made by turning the operating lever 80. That is, the turning of the operating lever 80 in a predetermined direction will result in the movement of the nut 78 relative to the threaded portion 74 of the pressing rod 70 through the operating cylindrical body 79, correspondingly varying the spring pressure exerted by the compression spring 81, by means of which compression spring 81 the front and rear support levers 65 and 66 are swung toward or away from each other around the axes of the transverse shafts 10 and 68 to vary the pressing force exerted on the lower surface of the monorail 1 by the front and rear auxiliary wheels 52 and 53. Thus, particularly when the monorail 1 has many slope regions, it is preferrable to tighten the nut 78 so that it is forwardly moved relative to the threaded portion 74, thereby setting the spring pressure of the compression spring 81 to a higher value.

When the starting button of the dc motor 15 is pressed, and dc motor 15 is started by a current flowing through the feeder lines 54, 82 and current collector 86, so that the driving wheel 18 begins to rotate in a clockwise direction as viewed in FIG. 1 through the output pulley 33, belt 32 and drive pulley 31 and hence the meshing between the meshing portion 22 of the driven wheel 18 and the mating meshing portion 27 of the inner peripheral surface of the endless driving belt 26 causes the endless driving belt 26 to be rotated along with the driving wheel 18, causing the traveling apparatus to travel on the monorail 1. In this case, since the endless driving belt 26 is entrained around the driving and driven wheels 18 and 19, the belt portion corresponding to the tread is pressed against the upper surface of the monorail 1, so that its area of contact with the monorail is much larger than that obtainable by the conventional wheel system in which the wheels independently contact the rail, thereby greatly increasing the coefficient of friction between the endless driving belt 26 and the monorail 1 for the traveling apparatus to exert sufficient hill climbing ability to go up even a steep slope rail portion. Further, when the coefficient of friction between the monorail 1 and the endless driving belt 26 is very high, it sometimes happens that when the traveling apparatus is going up a steep slope rail portion, a slippage occurs between the driving wheel 18 and the endless driving belt 26, decreasing the hill climbing ability. However, by driving the endless driving belt 26 from the driving wheel 18 through the meshing portion 22 and the mating meshing portion 27, it is possible to ensure that there will be no loss in the transmission of power therebetween.

When the traveling apparatus traveling along a horizontal region of the monorail 1 comes to a slope region thereof, if the angle of inclination of the slope is very large, a construction in which the support shafts 20 and 21 for the driving and driven wheels 18 and 19 would be directly supported by the transport vehicle body 2 would develop the so-called lateral contact condition in which only the portion of the endless driving belt 26 corresponding to the driving wheel 18 contacts the monorail 1 owing to the fact that the endless driving belt 26 is entrained around the driving wheels 18 and 19, thus sometimes making the passage of the traveling apparatus over slope very difficult in the initial stage of climbing. However, since the driving and driven wheels 18 and 19 are pivotally connected to the driving vehicle body 11 and the latter is pivotally connected to the transport vehicle body 2 by the transverse shaft 10 disposed intermediate between the driving and driven wheels 18 and 19, the driving vehicle body 11 will swing along the slope of the monorail 1 in the above-mentioned case so that the endless driving belt 26 will always approximately constantly contact the monorail 1. In a horizontal region of the monorail 1, the load on the transport vehicle body 2 acts on the driving vehicle body 11 through the transverse shaft 10 and the pressing forces of the driving and driven wheels 18 and 19 on the monorail 1 are, of course, uniform. Moerover, even in the case of said slope rail region, the driving and driven wheels 18 and 19 are always uniformly pressed against the monorail 1. More particularly, the pressing force of the auxiliary wheel 52 afforded by the compression spring 81 acts on the transverse shaft 10 disposed between, especially at the center between, the driving and driven wheels 18 and 19, whereby the driving and driven wheels 18 and 19 are uniformly pressed against the monorail 1. Therefore, there is no slippage at the start of and during hill climbing and a great improvement of the traveling performance can be expected.

When the traveling apparatus moves along a curved rail region in a horizontal plane, the endless driving belt 26 will assume an attitude tangential to the curve of the monorail 1, but the provision of the caster wheel 8 as a rear wheel of the transport vehicle body 2, which will then be pressed against the upper surface of the monorail 1 along with the endless driving belt 26, coupled with the fact that the front and rear wheels 52 and 53 are pressed against the lower surface of the monorail 1, thereby to hold the monorail from above and below, will greatly improve the traveling attitude during traveling along said curved rail region. Further, the provision of the flanges 9, 24, 25, 59, 60 on all the wheels prevents the traveling apparatus from running off the monorail 1 and enables it to travel smoothly and fast while following the curved rail region.

The fact that the compression spring 81 is disposed between the nut 78 threadedly engaged with the threaded portion 74 of the pressing rod 73 and the retainer 73 means that it performs the function of pressing both the front and rear auxiliary wheels 52 and 53. Such arrangement serves to uniformly press the front and rear wheels 53 and 54 against the lower surface of the monorail 1. Further, feeder line 54 in the form of a strip is mounted on the lower surface of the monorail 1, but if the front and rear auxiliary wheels 52 and 53 are centrally provided with circumferential grooves 55 and 56 and arranged to have their steps 57 and 58 pressed against the lower surface of the monorail, then there is obtained an advantageous arrangement wherein damage to the feeder line 54 or to the front and rear auxiliary wheels 52, 53 can be avoided and the pressing attitude of the front and rear auxiliary wheels 52, 53 is greatly stabilized.

When it is desired to remove the traveling apparatus from the monorail 1, the nut 78 is threadedly rearwardly moved by means of the operating lever 80 until the compression spring 81 is in a free state. Thereupon, the front and rear support levers 65 and 66 hang down from the transverse shafts 10 and 68 under the weight of the front and rear wheels 52, 53, etc., with the front and rear wheels disengaged from the monorail 1. Thereafter, by slightly lifting the transport and driving vehicle bodies 2 and 11 and then laterally moving them, the traveling apparatus can be easily removed.

Although the feeder line 54 has been shown as minus and the feeder line 82 as plus in the illustrated example, the feeder line 82 may be removed and the feeder line 54 may be suitably insulated to serve as the plus line. In that case, the monorail 1 may be utilized as the minus line. Further, other forms of material than a strip may be used for the feeder line 54. The front and rear lower wheels 52 and 53 may be of the split type in which split bodies consisting of steps 57, 58 and flanges 59, 60 are used and such two split bodies are fitted over the transverse shaft 61, 62 so as to be opposed to each other with a collar or the like interposed therebetween to serve as the circumferential groove 55, 56. Also, the monorail 1 may be installed in an orchard or the like and a container holding fruit or the like may be placed on the transport vehicle body. In this manner, the present invention may be used to transport fruit in addition to golf equipment.

What is claimed is:

1. A monorail transport apparatus comprising a transport vehicle body provided with a caster wheel rollable on a monorail having upper and lower surfaces, a driving vehicle body partly received in and pivotally connected to the front portion of said transport vehicle body so as to be swingable around the axis of a transverse shaft, a driving wheel and a driven wheel disposed on opposite sides of said transverse shaft, an endless driving belt entrained around said driving and driven wheels and pressed against the upper surface of said monorail, and an auxiliary wheel pivotally connected to said driving vehicle body so as to be swingable around the axis of said transverse shaft and pressed against the lower surface of the monorail, the arrangement being such that the monorail transport apparatus is propelled along the monorail by means of the driving vehicle body which engages the monorail from above and below between said endless driving belt and said auxiliary wheel.

2. A monorail transport apparatus as set forth in claim 1, wherein when the driving and driven wheels are pivotally connected to the driving vehicle body, the driving and driven wheels are disposed on opposite sides of and symmetrically with respect to the axis of the transverse shaft.

3. A monorail transport apparatus as set forth in claim 1, wherein when the endless driving belt is entrained around the driving and driven wheels, the driving and driven wheels are provided with meshing portions in the form of corrugations and endless driving belt is also provided with a meshing portion in the form of corrugations adapted to mesh therewith, so that the endless driving belt is rotated through such meshing construction

4. A monorail transport apparatus as set forth in claim 1, wherein, wherein when the auxiliary wheel is connected to the driving vehicle body so as to be swingable around the axis of the transverse shaft, there is provided a support lever suspended from one end of the transverse shaft for pivotally mounting the auxiliary wheel at the lower end of said support lever and said auxiliary wheel is pressed against the lower surface of the monorail by a compression spring.

5. A monorail transport apparatus as set forth in claim 4, wherein the auxiliary wheel arrangement consists of a front auxiliary wheel pivotally mounted at one end of a swingable front support lever suspended from one end of the transverse shaft and a rear auxiliary wheel pivotally mounted at the lower end of a swingable rear support lever pivotally suspended from the transport vehicle body through a second transverse shaft, a pressing rod is pivotally connected to one of said front and rear support levers, said pressing rod being inserted in a retainer pivotally connected to the other support lever, the inserted end portion of said pressing rod being formed with a threaded region, and a compression spring is disposed between a nut threadedly fitted over said threaded region and said retainer, thereby pressing the auxiliary wheels against the lower surface of the monorail.

* * * * *